US008432319B2

(12) United States Patent
Yukimoto et al.

(10) Patent No.: US 8,432,319 B2
(45) Date of Patent: Apr. 30, 2013

(54) ANTENNA DEVICE

(75) Inventors: Shinsuke Yukimoto, Tokyo (JP); Takao Yokoshima, Tokyo (JP)

(73) Assignees: Mitsubishi Cable Industries, Ltd., Tokyo (JP); Mitsubishi Materials Corporation, Tokyo (JP)

( * ) Notice: Subject to any disclaimer, the term of this patent is extended or adjusted under 35 U.S.C. 154(b) by 324 days.

(21) Appl. No.: 12/992,707

(22) PCT Filed: May 14, 2009

(86) PCT No.: PCT/JP2009/002105

§ 371 (c)(1),
(2), (4) Date: Dec. 29, 2010

(87) PCT Pub. No.: WO2009/139166

PCT Pub. Date: Nov. 19, 2009

(65) Prior Publication Data

US 2011/0140981 A1 Jun. 16, 2011

(30) Foreign Application Priority Data

May 15, 2008 (JP) ..... 2008-128867
Apr. 28, 2009 (JP) ..... 2009-108897

(51) Int. Cl.
*H01Q 1/24* (2006.01)

(52) U.S. Cl.
USPC ..... 343/700 MS; 343/846; 343/848

(58) Field of Classification Search ..... 343/700 MS, 343/829, 846, 848, 849
See application file for complete search history.

(56) References Cited

U.S. PATENT DOCUMENTS 3,355,740 A * 11/1967 Mayes ..... 343/792.5
3,366,963 A * 1/1968 Goff ..... 343/741
3,508,271 A * 4/1970 Kuecken ..... 343/745
5,572,222 A * 11/1996 Mailandt et al. ..... 343/700 MS
6,326,919 B1 * 12/2001 Diximus et al. ..... 343/700 MS
6,339,402 B1 * 1/2002 McKivergan ..... 343/702
6,985,108 B2 * 1/2006 Mikkola et al. ..... 343/700 MS

FOREIGN PATENT DOCUMENTS

JP 09-167214 A 6/1997
JP 11-154815 A 6/1999
JP 2006-180463 A 7/2006
JP 2007-243276 A 9/2007

OTHER PUBLICATIONS

International Search Report for Appln. No. PCT/JP2009/002105 mailed Aug. 4, 2009.

* cited by examiner

*Primary Examiner* — Tho G Phan
(74) *Attorney, Agent, or Firm* — Carter, DeLuca, Farrell & Schmidt

(57) ABSTRACT

An antenna device, wherein the polarization is improved by an identical antenna or substrate, and a higher gain and a smaller size are provided even when the installation conditions are changed. The antenna includes a base provided with a power feed point electrically connected to a power feed unit in a wireless circuit, an antenna element set up on the base and electrically connected to the power feed point, and a ground pattern provided on the base. The antenna element includes a rise part which rises from the base and an element part extending from the top edge of the rise in any direction in the plane parallel to the base. The ground pattern is divided into at least two ground regions by a boundary, and a ground connection part which electrically and locally connects the ground regions.

8 Claims, 5 Drawing Sheets

ANTENNA DEVICE

TECHNICAL FIELD

The present disclosure relates to an antenna device that can be advantageously used in a wireless communication technology such as a keyless operation system for an automobile and the like.

BACKGROUND

In recent years, antenna devices using linear elements have been investigated for the purpose of use in wireless communication, such as in a keyless operation system for an automobile. Conventionally, a monopole antenna having a length ¼ that of the working wavelength of the antenna with respect to the ground plane and in which a wire element is disposed is generally used as an antenna device that uses linear elements. However, because this monopole antenna is large and tall overall, inverted-L antennas have been developed in which this monopole antenna is folded at an intermediate point to reduce the size and height.

Furthermore, in this inverted-L antenna, matching a 50Ω power feed line is very difficult because the reactance, which is determined by the length of the horizontal portion of the antenna element that is parallel to the ground plane, is the capacitance, and is a large value. Thus, conventionally, in order to facilitate matching between an antenna element and a 50Ω power feed line, what is referred to as an inverted-F antenna has been proposed. This inverted-F antenna is one in which a stub is provided that connects the ground plane and the radiation element near the power feed point that is provided at an intermediate location on the antenna element. Thereby, the capacitance due to the reactance is neutralized, and matching a 50Ω power feed line is facilitated. For example, in Japanese Laid-Open Patent Application No. 2006-197528, an inverted-F antenna has been proposed that is applied to a folding portable wireless device, and provides an antenna element that is disposed on a printed wiring substrate and is folded perpendicular to a flexible flat cable that is connected to the printed wiring substrate. In this inverted-F antenna, the antenna element is folded in a vertical direction with respect to the printed wiring substrate.

However, in the above conventional technology as well, the following problems remain. Specifically, in the conventional antenna, in the case in which the various arrangement conditions are to be changed, the polarization (vertical and horizontal polarization) is designed with respect to the principal polarization as required by the use conditions, and due to being dependent thereon, handling polarization improvements using the same antenna profile is difficult. Thus, methods in which design changes are made to the antenna profile in order to improve polarization have been considered, but there are limits to design changes due to dependency on the size of the case and there are frequently difficulties in terms of the cost of producing metal molds and the like. Thus, a method in which a metal plate is disposed to change the polarization forcibly has been considered, but there the drawbacks that directionality is limited, antenna characteristics deteriorate, and the polarization cannot be easily improved.

In addition, in the case of the technology disclosed in Japanese Laid-Open Patent Application No. 2006-197528, the characteristics are improved by folding the element in a length or width direction with respect to a flexible cable, but because the improvements in characteristics are dependent on the surrounding environment, the polarization and directionality cannot be improved, and downsizing and increasing the thinness are difficult. From the above point of view, in the case in which the arrangement conditions are changed in the conventional technology, in the same antenna, substrate, and case, there are the drawbacks that improving the polarization, obtaining high gain, downsizing, and increasing thinness are difficult.

SUMMARY

In consideration of the above described problems, it is an object of the present disclosure to provide an antenna device that improves the polarization of the same antenna and substrate and the like and can realize a high gain and downsizing even in the case in which the arrangement conditions change.

The present disclosure uses the following structure to solve the problems described above. Specifically, the antenna device of the present disclosure provides a first ground area on which a power feed component that is electrically connected to the power feed point of a wireless circuit is provided and that is formed by a conductor; a second ground area that is provided along the outer periphery of the first ground area so as to exclude a portion of the periphery thereon and that is formed by a conductor; a boundary between the first ground area and the second ground area; an antenna element that is electrically connected to the power feed point and is erected on the first ground area; and a ground connection component that locally electrically connects the first ground area and the second ground area. The antenna element is characterized in providing a raised component that rises from the first ground area and an element component that extends directly above the second area from the raised component.

Because this antenna device provides a ground connection component that locally electrically connects the first ground area and the second ground area, and the antenna element includes a raised component that rises from the first ground area and an element component that extends directly above the second ground area from the upper end portion of the rising area, high frequency current (current distribution) that flows to the antenna element, the first ground area, and the second ground area can be adjusted depending on the local connection position, and the polarization of the antenna overall can be improved. That is, a ground area that is divided into a plurality of parts is provided, and the characteristics of the desired polarization can be improved without changing the antenna element based on the dispositional relationship between these ground elements and the antenna element.

Note that the above term "boundary" denotes (electrically divided) portions at which the first ground area and the second ground area are not electrically connected. Specifically, this "boundary" is an area or space at which the conductor of the first ground area and the conductor of the second ground area are not linked together, and denotes an electrically insulated range that is interposed between the first ground area and the second ground area.

In addition, providing the above "locally electrically connected ground connection component" denotes that there is a location (the ground connection component) that electrically connects the first ground area and the second ground area by crossing over the "boundary".

In addition, the antenna device of the present disclosure provides a substrate on which a ground pattern that is divided into the first ground area and the second ground area is provided.

A ground pattern that is provided on a substrate frequently naturally has large in size and is integrated from the viewpoint of improving the antenna gain. Thus, in the present disclosure, because a boundary for efficiently dividing the ground pattern of the substrate for the antenna element is provided and the frequency current flowing to the antenna element and the ground pattern is adjusted, the polarization of the antenna overall can be improved by making an efficient connection method.

In addition, the antenna device of the present disclosure provides a first substrate on which the first ground area is provided and a second substrate on which the second ground area is provided, and the first substrate and the second substrate are disposed such that the boundary is interposed therebetween.

Specifically, in this antenna device, because the first substrate and the second substrate are disposed such that the boundary is interposed therebetween, by providing the first ground area and the second ground area on separate substrates, an arrangement becomes possible in which one can be easily be replaced with another having a separate shape. For example, by using a general use substrate for one and using a replacement substrate for the other, a variety of shapes can be easily used.

In addition, in the antenna device of the present disclosure, the boundary is perpendicular to the element component at least at one location in a plan view from above the first ground area and the second ground area. Specifically, in this antenna device, because the boundary is perpendicular to the element component at least at one location in a plan view from above the first ground area and the second ground area, the current distribution can be most effectively adjusted.

In addition, in the antenna device of the present disclosure, the boundary divides the first ground area and the second ground area in proximity to the power feed point. Specifically, in this antenna device, because the boundary divides the first ground area and the second ground area in proximity to the power feed point, a current distribution can be more robustly adjusted.

In addition, in the antenna device of the present disclosure, the ground connection component is provided at a proximate position near the power feed point. Specifically, in this antenna device, because the ground connection component is provided at a proximate position near the power feed point, when the principal polarization is made the horizontal polarization, the effect of the improvement of the horizontal polarization can be more robustly obtained.

In addition, in the antenna device of the present disclosure, the ground connecting component is provided at a distant position most separated from the power feed point. Specifically, in this antenna device, because the ground connecting component is provided at a distant position most separated from the power feed point, when the principal polarization is vertical polarization, the effect of the improvement of the vertical polarization can be more robustly obtained.

In addition, in the antenna device of the present disclosure, the ground connection component is provided at an intermediate position on the boundary. Specifically, in the antenna device, because the ground connection component is provided at an intermediate position on the boundary, in the case in which both horizontal polarization and the vertical polarization are necessary, the effect of a significant improvement of both polarizations can be obtained.

According to the present disclosure, the following effects are exhibited

According to the antenna device of the present disclosure, because a ground connection component that locally electrically connects the first ground area and the second ground area is provided, and the antenna element includes a raised component that rises from the first ground area and an element component that extends directly above the second ground area from the upper end portion of the raised component, the high frequency current that flows to the antenna element, the first ground area, and the second ground area can be adjusted depending on the local connection position, and the polarization of the antenna overall can be improved. Specifically, even in the case in which the arrangement conditions are changed, based on the dispositional relationship between the above connection positions and the antenna element, the polarization can be improved, and increased gain and downsizing can be realized without changing the antenna element. Therefore, the antenna device of the present disclosure is advantageous for any wireless communication system that is mounted on a vehicle or the like, and in particular, a reception antenna device, a transmission antenna device, or a transmission and reception antenna device used in a wireless operation system.

DETAILED DESCRIPTION

Below, a first embodiment of the antenna device according to the present disclosure will be explained with reference to FIG. 1 to FIG. 8.

Figure 1:
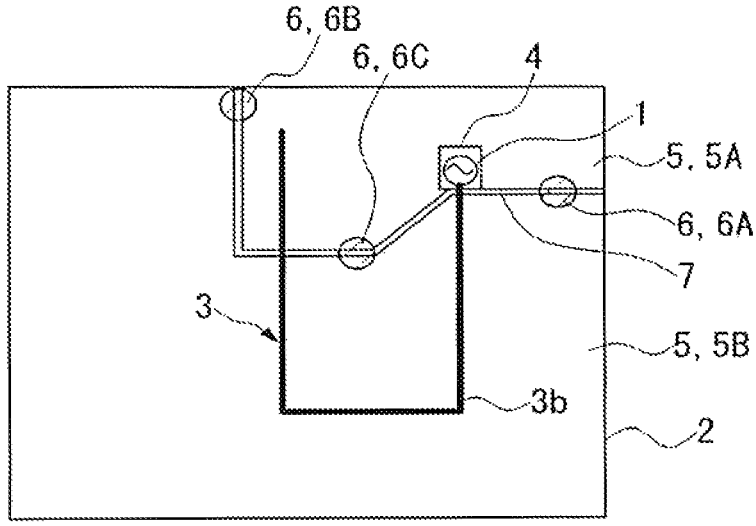
FIG. 1 is a simple plan view that shows the antenna device of a first embodiment of the antenna device of the present disclosure.
Figure 2:
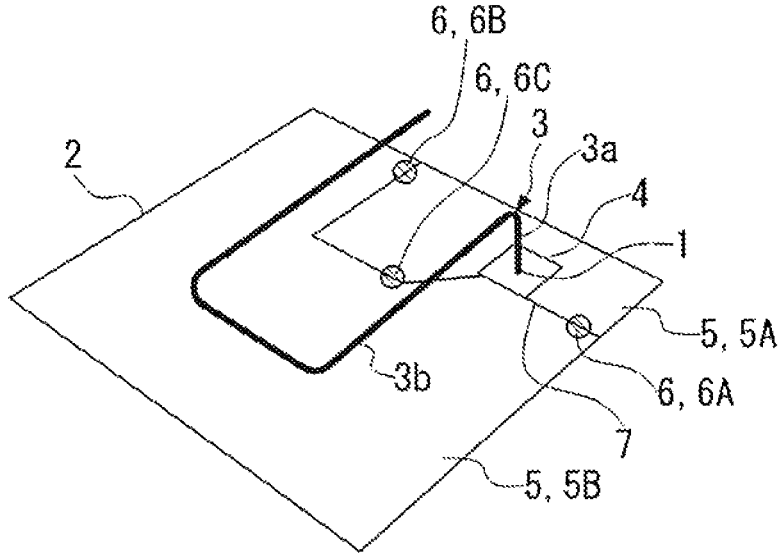
FIG. 2 is a simple perspective view that shows the antenna device of the first embodiment.
Figure 3:
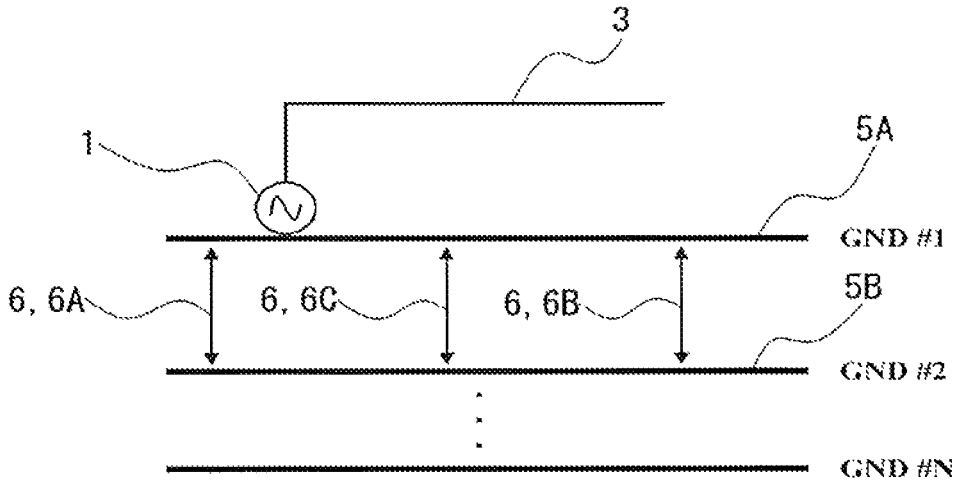
FIG. 3 is an explanatory drawing using an equivalent circuit that shows the antenna device of the first embodiment.

The antenna device of the present embodiment is a wireless communication system that is mounted, for example, in an automobile or the like, and in particular, is a reception antenna device, a transmission antenna device, or a transmission and reception antenna device used in a keyless operation system. As shown in FIGS. 1 to 3, the antenna device provides a first ground area 5A on which a power feed point 1 that is electrically connected to a 50Ω power feed line (power feed component of the wireless circuit; not illustrated) and is formed by a conductor such as copper foil or the like; a second ground area 5B that is formed by a conductor such as copper foil or the like along the outer periphery of the first ground area 5A so as to exclude a portion thereof; a boundary 7 between the first ground area 5A and the second ground area 5B; an antenna element 3 that is electrically connected to the power feed point 1 and is erected above the first ground area 5A; and a ground connection component 6 that locally electrically connects the first ground area 5A and the second ground area 5B.

In addition, the antenna device provides a substrate 2 on which a ground pattern 5 is provided, which is divided in to the first ground area 5A and the second ground area 5B; and a matching circuit component 4, which is electrically connected to the power feed point 1 and the antenna element 3, provided on the substrate 2, and that matches the reactance of the antenna element 3 and the power feed line.

Specifically, this antenna device provides a substrate 2 on which a power feed point 1, to which a 50Ω power feed line (not illustrated) is electrically connected, is provided; an antenna element 3 that is electrically connected to the power feed point 1 and is erected on the substrate 2; a matching circuit component 4 that is electrically connected to the power feed point 1 and the antenna element 3, erected on the substrate 2, and matches the reactance of the antenna element 3 and the power feed line; and a ground pattern 5 that is provided on the substrate 2.

Note that the key operation system described above denotes a system that enables the locking or unlocking operation (what is referred to as a "keyless entry system") of the doors or tailgate and the like of an automobile and the startup of an engine and the like by carrying out a check of an ID code by wireless communication between the key and the receiving antenna device arranged on automobile main body side when a driver or the like simply approaches the vehicle within a wireless operation range carrying a key that is referred to as a "keyless operation key" and that has a wireless communication function.

The substrate 2 is, for example, a wired substrate or a circuit substrate, and a wireless communication circuit or an electronic control unit (ECU) or the like (not illustrated) including the matching circuit component 4, are formed on the upper surface and the lower surface thereof. Note that the antenna element 3 may also be installed on a side opposed to the surface on which the electronic control unit of the substrate 2 is mounted.

The antenna element 3 is formed by a conductive material such as copper wire, copper-clad wire, copper alloy wire (for example, brass) aluminum wire, aluminum-clad wire, or aluminum alloy wire or the like, having a length that is ¼ or another integer fraction of that of the antenna working wavelength, and the thickness of the wire is set according to desired characteristics. In addition, the shape of the wire may be a cross-sectional profile of a circle, rectangle, or polygon or the like. In consideration of bending, a circular cross-section is preferable.

In addition, the antenna element 3 may be covered by an insulating layer on the outer periphery of the conducting materials (wire) described above.

This antenna element 3 includes a raised portion 3*a* that rises from the first ground area 5A and an element component 3*b* that extends directly above the second ground area 5B from the upper end portion of the raised portion 3*a*.

Specifically, this antenna element 3 includes a raised portion 3*a* that rises from the substrate 2, and an element 3*b* that bends from the upper end portion of the raised portion 3*a* and extends in an arbitrary direction within a plane parallel to the substrate. The element component 3*b* of the present embodiment is an open element that bends or curves back at an intermediate portion after extending in a direction in a plane parallel to the substrate 2 from the upper end portion of the raised portion 3*a*, and forms substantially square-C shape that extends along a direction opposite to the first direction.

Note that the element component 3*b* may extend in an arbitrary direction after extending directly over the second ground area 5B from the first ground area 5A, but from the point of view of ease of formation of the antenna and stability of the antenna characteristics, as explained above, the element component 3*b* is formed so as to extend in an arbitrary direction in a plane parallel to the substrate 2.

As described above, the ground pattern 5 is divided into the first ground area 5A and the second ground area 5B at the boundary 7, which is a separation line on the substrate 2, and at the same time, includes a ground connecting portion 6 that locally electrically connects these ground areas 5A and 5B. In the present embodiment, the ground pattern 5 is divided into the first ground area 5A for analogue circuits and a second ground area 5B for digital circuits. In this ground pattern 5, the second ground area 5B is arranged along the outer periphery first ground area 5A so as to exclude a portion (the upper edge side and the right edge side in FIG. 1) of the outer periphery. Specifically, the second ground area 5B is disposed so as to leave open and not completely surround at least one portion of the outer periphery of the first ground area 5A. Note that in the case in which the ground pattern 5 is divided at a plurality of locations, it is desirable that as large an area as possible for each of the ground areas 5A and 5B be ensured.

The boundary 7 is a line shaped or band shaped non-patterned portion that electrically divides the ground pattern 5 into the first ground area 5A and the second ground area 5B, except at a portion locally electrically connected by the ground connecting portion 6.

In addition, the first ground area 5A and the second ground area 5B are divided by the boundary 7 into such shapes as shown in FIG. 1 in conformity to the shape of the substrate 2. However, for example, the second ground area 5B may be divided into an alternative shape such as a rectangle by the boundary 7.

The boundary 7 intersects the element component 3*b* in a plan view from above the first ground area 5A and the second ground area 5B. In particular, the boundary 7 is perpendicular to the element component 3*b* in a plan view from above the first ground area 5A and the second ground area 5B at least at one location, and the ground pattern 5 is divided in proximity to the power feed point 1. In the present embodiment, in a plan view, the boundary 7 is perpendicular to the substantially C-shaped element component 3*b* at two at locations.

The matching circuit component 4 is a circuit structure including a π-type LC circuit formed by a plurality of inductors L or capacitors C or a T-type circuit at a single stage or a plurality of stages between the power feed point 1 and the antenna element 3. This matching circuit component 4 has the function corresponding to a portion that achieves matching from the power feed point to the stub in a conventional inverted-F antenna.

The ground connecting portion 6 is provided at least at one location depending on the necessary polarization, and, for example, in the case that the principal polarization is horizontal polarization, the ground connecting portion 6 is provided at a proximate position 6A near the power feed point 1, and in the case in which the principal polarization is vertical polarization, the ground connecting portion 6 is provided at a distant location 6B most separated from the power feed point 1. Furthermore, in the case in which both horizontal polarization and vertical polarization are necessary, the ground connecting portion 6 is provided at an intermediate position 6C along the boundary 7.

Note that the terms "proximate" and "distant" with respect to the connection position of the ground connection component 6 denote distances from the power feed point 1 that is electrically connected to the antenna element 3 on the boundary 7.

In addition, passive elements such as generally used resistors, capacitors, and inducers and the like are used at the ground connecting portion 6.

Note that by using a variable resistor, a variable capacitor, or a variable inducer or the like as the ground connecting portion 6, flexible adjustment also becomes possible. In addition, a ground connecting portion 6 such as copper file or the like may be used.

Next, the results of measuring actual polarization and directionality of the antenna device of the present embodiment by varying the position of the ground connecting portion 6 for will be explained.

Figure 4:
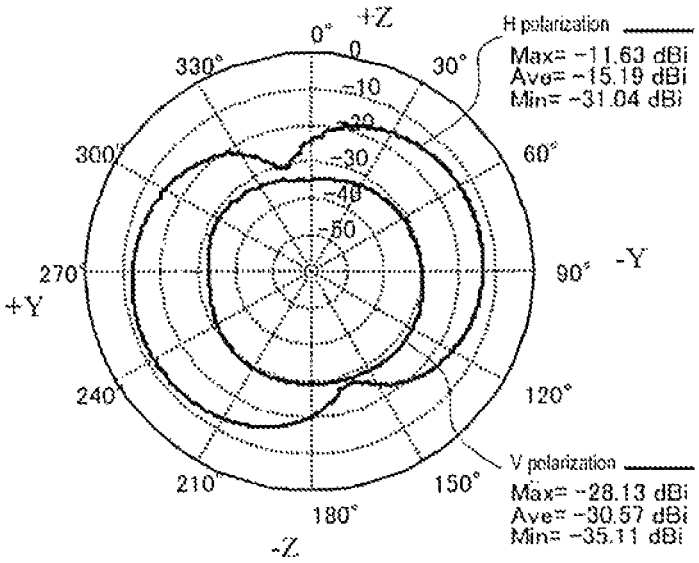
FIG. 4 is a graph that shows, in a first embodiment, a radiation pattern in the case in which the ground connection component is provided at a proximate position near the power feed point in the first embodiment.

First, FIG. 4 shows the result of measuring the radiation pattern for the case in which the ground connection component 6 is provided at the proximate location 6 near the power feed point. As can be understood from this result, advantageous results are obtained for a radiation pattern whose principal polarization is horizontal polarization, has a toroidal directionality, and has a maximum gain of −11.63 dBi. In addition, here the maximum gain of the vertical polarization is a low value of −28.13 dBi.

Figure 5:
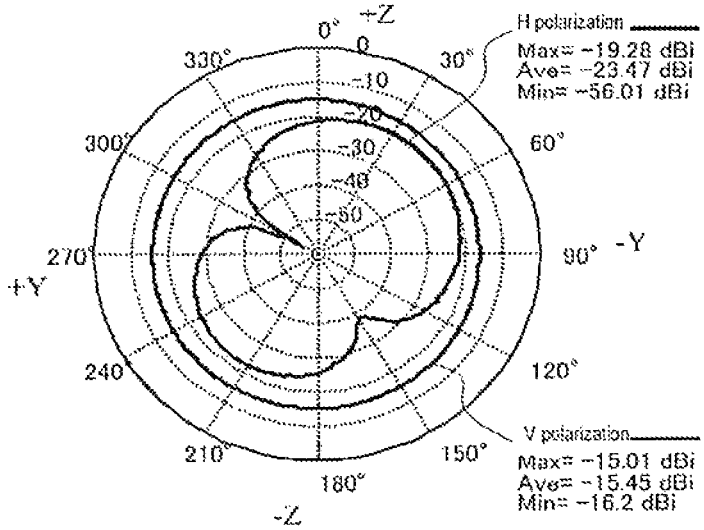
FIG. 5 is a graph that shows, in the first embodiment, a radiation pattern in the case in which the ground connection component is provided at a distant position far from the power feed point.

In addition, FIG. 5 shows the result of measuring a horizontal radiation pattern of substrate 2 for the case in which the ground connection component 6 is provided at the distant position 6B far from the power feed point 1. As can be understood from this result, the principal polarization of the radiation pattern is vertical polarization, and thus, the principal polarization changes in comparison to the case in which the ground connection component 6 is provided at the proximate position 6A. Note that the horizontal polarization having a toroidal directionality remains as-is, but the maximum gain becomes −19.28 dBi. In addition, in contrast, the maximum gain of a vertical polarization, which is the principal polarization, is −15.01 dBi, and a high gain of 13 dB is obtained in comparison to the case in which the ground connection component 6 is provided at the proximate position 6A.

Figure 6:
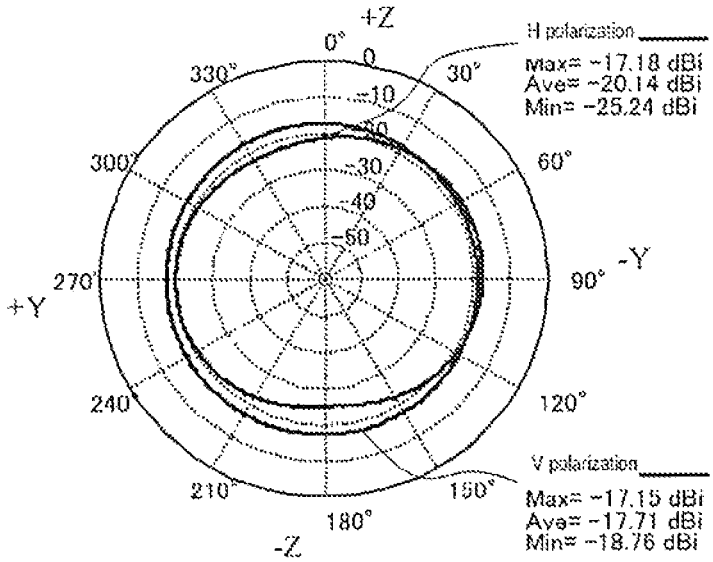
FIG. 6 is a graph that shows, in the first embodiment, a radiation pattern in the case in which the ground connection component is provided at an intermediate position on the boundary.

In addition, FIG. 6 shows the result of measuring the radiation pattern for the case in which the ground connection component 6 is provided at the intermediate position 6C of the boundary 7. As can be understood from this result, the vertical polarization and the horizontal polarization of the radiation pattern are both substantially identical, and a directionality of −17 dBi is obtained at the maximum gain.

Figure 7:
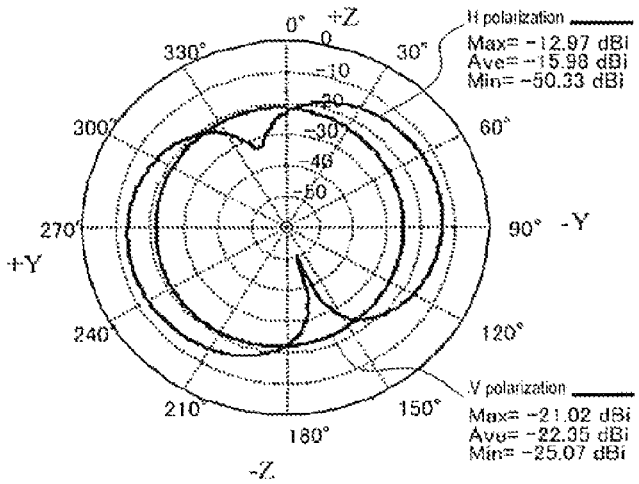
FIG. 7 is a graph that shows, in a first embodiment, the radiation pattern in the case in which the ground connection component is provided at three locations: at a proximate position near the power feed point, at a distant position far from the power feed point, and an intermediate position on the boundary.

In this manner, for the same antenna element 3, simply by changing only the connection position of the ground areas 5A and 5B, the polarization can be improved by adjusting the gain of the vertical polarization, the horizontal polarization, or both polarizations Note that FIG. 7 shows the results of measuring the radiation pattern for the case in which the ground connection component 6 is connected at all three locations, that is, the above proximate position 6A, the distant position 6B, and the intermediate position 6C. As can be understood from these results, the polarization obtaining the maximum gain, that is, the horizontal polarization when electrically connected at the proximate position 6A shown in FIG. 6, has a toroidal directionality and a maximum gain of −11.63 dBi, and thus, has characteristics similar to the state shown in FIG. 4. However, when compared to the radiation pattern in FIG. 4, an advantageous result is obtained in which the vertical polarization is improved and the maximum gain is −21.02 dBi. That is, by combining the connection positions of the ground areas 5A and 5B (the arrangement positions of the ground connection components 6), the high frequency current (current distribution) flowing to the antenna element 3 and the ground pattern 5 can be adjusted, and the polarization of the antenna overall can be improved.

Figure 8:
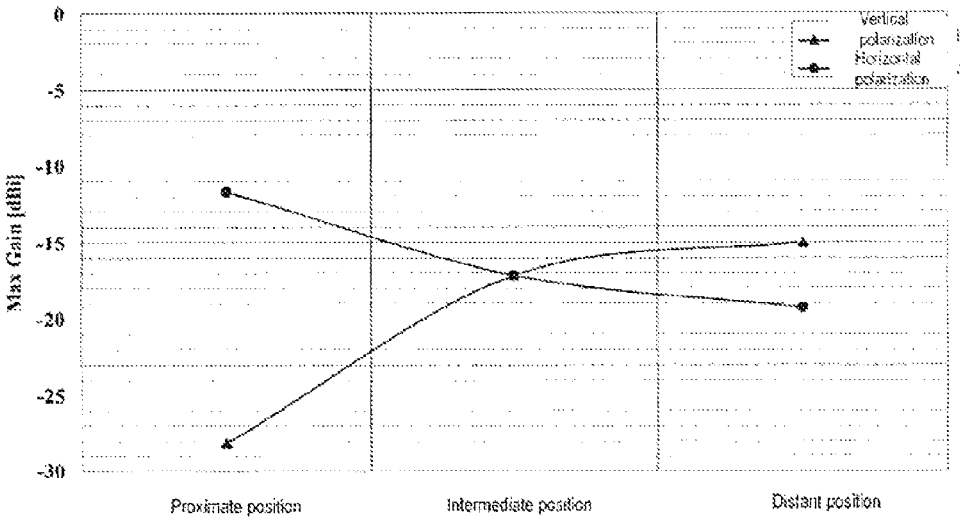
FIG. 8 is a graph that shows, in a first embodiment, a comparison of maximum gain for horizontal polarization and vertical polarization for the arrangement positions of the ground connection components.

In addition, as quantitative evidence, a comparison of maximum gain is shown in FIG. 8. This is the result of extracting the maximum gain for each of the horizontal and vertical polarizations for each of the radiation patterns from FIG. 4 to FIG. 6 and comparing the positions of the ground connection component 6. As can be understood from this result, the horizontal polarization deteriorates as the position of the ground connection component 6 becomes more distant from the power feed point 1, and the vertical polarization improves as the position of the ground connection component 6 becomes more distant from the power feed point 1. This means that the position of the ground connection component 6 is provided at the proximate position 6A near the power feed point 1 when the principal polarization is to be the horizontal polarization; the ground connection component 6 is provided at the distant position 6B far from the power feed point 1 in the case in which the principal polarization is to be the vertical polarization; and furthermore, the position of the ground connection component 6 is provided at the intermediate point 6C of the boundary in the case in which both polarizations are necessary. Thereby, the polarization can be improved. Note that FIG. 8 is the result comparing the radiation pattern of the horizontal plane of the substrate 2, but in the case of the radiation pattern of the other planes, the relationships in FIG. 8 are reversed.

In this manner, the antenna device of the present embodiment provides a ground connection component 6 that locally electrically connects the first ground area 5A and the second ground area 5B, and the antenna element 3 includes a rising area 3*a* that rises from the first ground area 5A and an element component 3*b* that extends directly above the second ground area 5B from the upper end portion of the rising portion 3*a*. Thus, the high frequency current (current distribution) that flows to the antenna element 3 and the ground pattern 5 (first ground area 5A and second ground area 5B) can be adjusted depending on the local connection position, and the polarization of the antenna overall can be improved. This means that plural divided ground areas 5A and 5B are provided, and based on the positional relationships between the connection positions thereof and the antenna element 3, the characteristics of the desired polarization can be improved without changing the antenna element 3.

Frequently, the size of the ground pattern 5 provided on the substrate 2 was naturally made large and integrated in consideration of improving the antenna gain. Thus, in the present embodiment, a boundary 7 for efficiently dividing the ground pattern 5 of the substrate 2 with respect to the antenna element 3 is provided, and in order to adjust the high frequency current that flows to the antenna element 3 and the ground pattern 5, the polarization of the antenna overall can be improved by an efficient connection method.

In addition, because the boundary 7 is perpendicular to the element component 3*b* in a plan view from above the first ground area 5A and the second ground area 5B at least at one location, the current distribution can be adjusted most effectively.

Furthermore, because the boundary 7 divides the ground pattern 5 in proximity to the power feed point 1, the current distribution can be adjusted more robustly.

In addition, when the ground connection component 6 is provided at a proximate position near the power feed point 1, in the case in which the principle polarization is horizontal polarization, the effect of an improvement in characteristics can be more robustly obtained.

In addition, when the ground connection component 6 is provided at a distant position most separated from the power feed point 1, in the case in which the principal polarization is vertical polarization, the effect of an improvement in vertical polarization can be more robustly obtained.

In addition, when the ground connection component 6 is provided at an intermediate position of the boundary 7, in the case in which both the horizontal polarization and the vertical polarization are necessary, the effect of an improvement in both polarizations can be more robustly obtained.

Next, a second embodiment of the antenna device according to the present disclosure will be explained with reference to FIG. 9. Note that in the following explanation of the embodiment, identical structural components explained in the above embodiment have appended identical reference numeral, and the explanation thereof is omitted.

Figure 9:
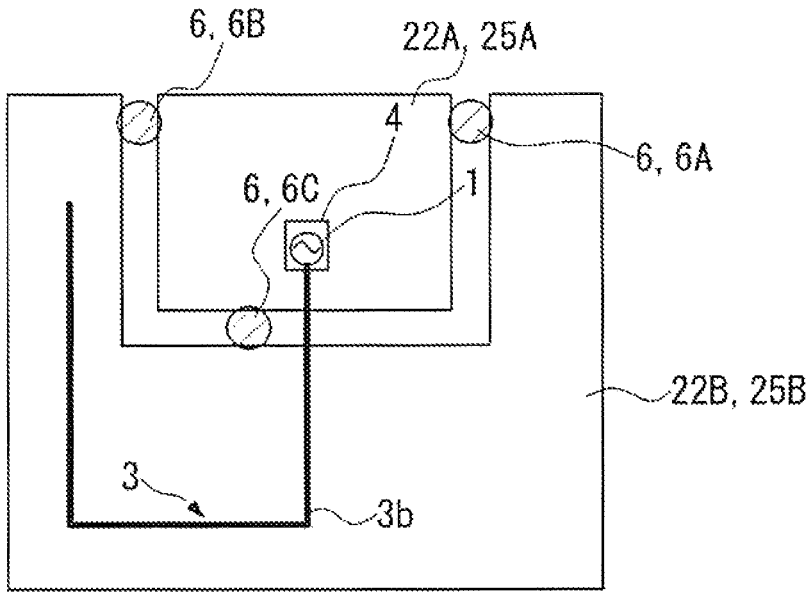
FIG. 9 is a simple plan view that shows an antenna device of a second embodiment of the antenna device according to the present disclosure.

The point of difference between the second embodiment and the first embodiment is that in the first embodiment a first ground area 5A and a second ground area 5B that are divided from each other on one substrate 2 by the boundary 7 are formed, whereas in contrast, the antenna device of the second embodiment, as shown in FIG. 9, provides a first substrate 22A on which the first ground area 25A is provided and a second substrate 22B on which a second ground area 25B is provided, and the first substrate 22A and the second substrate 22B are provided such that the boundary 27 is interposed therebetween.

The antenna device of this second embodiment provides a square shaped first substrate 22A and a recessed second substrate 22B that is arranged along the other three edges excluding one edge on the outer periphery of the first substrate 22A. Specifically, the antenna device of the second embodiment provides a square first ground area 25A formed on the first substrate 22A and a recessed second ground area 25B that is formed on the second substrate 22B along the outer periphery of the first ground area 25A so as to exclude a portion of the outer periphery thereof.

Therefore, the boundary 27 that divides the first ground area 25A and the second ground area 25B is not a dividing line on the substrate, but rather is a gap area between the first substrate 22A and the second substrate 22B.

In this manner, in the second embodiment, because the first substrate 22A and the second substrate 22B are disposed so as to surround the boundary 27, by providing the first ground area 25A and the second ground area 25B on separate substrates, an arrangement in which one is easily replaced by another having a different shape becomes possible. For example, by making one a general-use substrate and making the other a replacement substrate, a variety of shapes can be easily used.

Note that the present disclosure is not limited by the embodiments described above, but various modifications can be added within a range that does not depart from the spirit of the present disclosure.

For example, in the first embodiment, a ground pattern 5 is formed on the surface of a substrate 2, but there are cases in which a multilayer substrate is used as a substrate when designing an actual wireless circuit. In this case, the ground pattern 5 may be designed on any layer, such as an inner layer pattern. Note that ideally, the ground pattern 5 is designed on a component surface or solder surface of the surface of the substrate.

In addition, the antenna element 3 was formed by a conducting line made by a copper wire or the like, but the antenna element 3 may be formed by other conductors. For example, an antenna element that has been stamped on a metal plate and formed into a band (the cross-sectional profile being rectangular) may be formed.

What is claimed is:

1. An antenna device comprising:

a first ground area in which a power feed point that is electrically connected to a power feed portion of a wireless circuit is provided and that is formed by a conductor;

a second ground area that is provided along the outer periphery of the first ground area so as to exclude a portion of the periphery thereof and that is formed by a conductor;

a boundary between the first ground area and the second ground area;

an antenna element that is electrically connected to the power feed point and is erected on the first ground area; and a ground connection component that locally electrically connects the first ground area and the second ground area, wherein the antenna element includes a raised portion that rises from the first ground area and an element component that extends above the second ground area from the upper end portion of the raised portion.

2. An antenna device according to claim 1, further comprising a substrate that provides a ground pattern divided into the first ground area and the second ground area.

3. An antenna device according to claim 1, further comprising:

a first substrate on which the first ground area is provided; and a second substrate on which the second ground area is provided, wherein the first substrate and the second substrate are arranged such that the boundary is interposed therebetween.

4. An antenna device according to claim 1, wherein the boundary is perpendicular to the element component in a plan view from above the first ground area and the second ground area at least at one location.

5. An antenna device according to claim 1, wherein the boundary separates the first ground area and the second ground area in proximity to the power feed point.

6. An antenna device according to claim 1, wherein the ground connection component is provided at a proximate position near the power feed point.

7. An antenna device according to claim 1, wherein the ground connection component is provided at a distant position most separated from the power feed point.

8. An antenna device according to claim 1, wherein the ground connection component is provided at an intermediate position on the boundary.

* * * * *